US005655981A

United States Patent [19]

Reed

[11] Patent Number: 5,655,981

[45] Date of Patent: Aug. 12, 1997

[54] METALIZED HOCKEY STICK

[75] Inventor: Richard A. Reed, Cleveland, Ohio

[73] Assignee: Glastic Corporation, Cleveland, Ohio

[21] Appl. No.: 601,252

[22] Filed: Feb. 14, 1996

Related U.S. Application Data

[63] Continuation of Ser. No. 386,285, Feb. 9, 1995, abandoned.

[51] Int. Cl.[6] ..... A63B 59/12

[52] U.S. Cl. ..... 473/560; 473/321

[58] Field of Search ..... 273/67 R, 67 A; 473/316, 318, 321, 560, 561

[56] References Cited

U.S. PATENT DOCUMENTS

| | | | |
|---|---|---|---|
| 3,934,875 | 1/1976 | Easton et al. . | |
| 4,124,208 | 11/1978 | Burns . | |
| 4,188,032 | 2/1980 | Yanagioka | 273/80 R |
| 5,028,464 | 7/1991 | Shigetoh | 273/80 R X |
| 5,217,221 | 6/1993 | Baum | 273/67 A |
| 5,242,720 | 9/1993 | Blake | 273/80 R X |
| 5,332,212 | 7/1994 | Susi et al. | 273/67 A |

FOREIGN PATENT DOCUMENTS

13913/28 12/1928 Australia .

OTHER PUBLICATIONS

Magazine Article from The Sporting Goods Dealer, pp. 49 and 146, Dec., 1972.

*Primary Examiner*—Raleigh W. Chiu
*Attorney, Agent, or Firm*—D. Peter Hochberg; Mark Kusner

[57] ABSTRACT

A shaft for a hockey stick comprised of a non-metallic elongated member having a generally rectangular cross-section; a first layer comprised of a resilient yet tough material bonded to the member; a second layer comprised of metal applied to the first layer by a metal deposition process; and a third layer comprised of a clear resilient, tough material encasing said second layer of metal.

6 Claims, 1 Drawing Sheet

METALIZED HOCKEY STICK

This is a continuation of application Ser. No. 08/386,285 filed on Feb. 9, 1995 now abandoned.

FIELD OF THE INVENTION

The present invention relates generally to hockey sticks, and more, particularly to a non-metallic shaft for a hockey stick having an outer metallic layer to enhance the appearance thereof.

BACKGROUND OF THE INVENTION

Traditional wood hockey sticks experience a high rate of wear, fatigue and breakage as a result of the severe stress and strain exerted thereon during a typical hockey game. Hockey sticks formed of other materials less susceptible to wear and breakage than conventional wood sticks are known. For example, U.S. Pat. No. 3,934,875 to Easton et at. discloses a hockey stick having an elongated hollow shaft formed of a high strength aluminum alloy. It is also known to provide shafts for hockey sticks formed of non-metal materials, such as plastics and composites. Hockey stick shafts formed of plastic or composite materials offer a wide range of performance as well as cost. In this respect, some composite shafts can rival the high strength and superior performance of metal shafts. However, like alloy metal shafts, they are generally more costly than wood and are therefore generally used by players such as professionals or advanced amateurs. In this respect, the higher performance and higher cost of an alloy aluminum or expensive composite hockey stick is generally not required or commensurated with the skill level of most amateur hockey players. Lesser-priced composite sticks or plastic hockey sticks are generally more suited, price-wise and performance-wise, for beginners and most amateur hockey players. However, many amateurs and professionals, whether using high-end or low-end non-metallic sticks, prefer the appearance or look of a metal shaft hockey stick for the image and radiance they provide.

The present invention thus provides a hockey stick and particularly the shaft therefor, which shaft is formed primarily of a non-metallic material having a brilliant metallic outer surface to enhance the appearance thereof, which metallic finish does not affect the physical properties of the non-metallic shaft, yet is strong and durable enough to withstand the forces and impacts exerted thereon during hockey games.

SUMMARY OF THE INVENTION

In accordance with the present invention, there is provided a shaft for a hockey stick comprised of an elongated member formed of a graphite fiber and a polymer matrix. A layer of an adhesion enhancing material is applied to the composite elongated member. A thin metallic layer is applied to the base layer by a vapor vacuum deposition process. A clear protective layer is applied over the metal layer. The base layer, metallic layer and top layer have an overall thickness of less than approximately 0.003 inches.

In accordance with another aspect of the present invention, there is provided a shaft for a hockey stick comprised of a composite member formed of graphite fiber in a polymer matrix, a base layer of a plastic material bonded to the member, a metallic layer encasing the base layer, the metallic layer being applied to the base layer by a vacuum deposition procedure, and a top layer of a clear plastic material, wherein the base coat, metal layer and top coat having a thickness of less than approximately 0.003 inches.

In accordance with another aspect of the present invention, there is provided a shaft for a hockey stick comprised of an elongated member formed primarily of a non-metallic material, an inner layer comprised of an adhesion-promoting and surface-smoothing material covering the outer surface of the tubular member, an intermediate layer comprised of deposited metal covering the first layer, the second layer having a thickness not greater than 0.000001 inch, and an outer layer comprised of a clear, tough yet resilient material.

It is an object of the present invention to provide a shaft for a hockey stick having performance characteristics of a polymer composite or wood shaft with the external appearance of a metalized shaft.

Another object of the present invention is to provide a shaft as described above which is formed of a non-metallic material having a outer visible metallic surface.

Another object of the present invention is to provide a shaft for a hockey stick having a brilliant metallic outer surface.

A still further object of the present invention is to provide a shaft as described above wherein the outer metallic surface is comprised of a metal selected from the group consisting of aluminum, copper, gold or silver.

Another object of the present invention is to provide a method of applying a metal coating to a non-metallic shaft for a hockey stick.

Another object of the present invention is to provide a method as described above wherein the metallic material is applied by a vacuum vapor deposition process.

Another object of the present invention is to provide a method as described above wherein the metallic material is applied by an ion sputtering technique.

These and other objects and advantages will become apparent from the following description of a preferred embodiment of the invention taken together with the accompanying drawings.

BRIEF DESCRIPTION OF THE DRAWINGS

The invention may take form in certain parts and arrangement of parts, preferred embodiments of which will be described in detail in the specification and illustrated in the accompanying drawings wherein.

BRIEF DESCRIPTION OF PREFERRED EMBODIMENT

Figure 1:
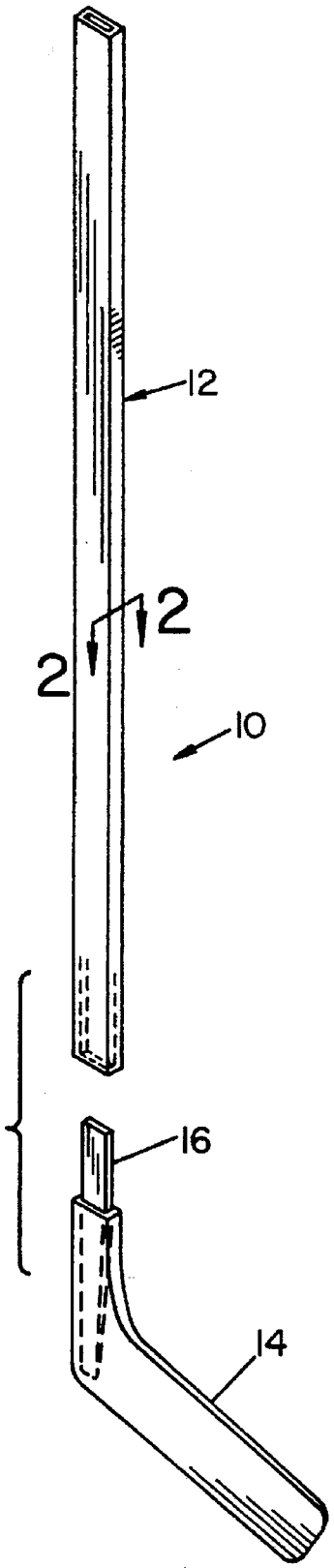
FIG. 1 is an exploded view of a hockey stick showing a tubular shaft according to the present invention.

Referring now to the drawings wherein the showings are for the purpose of illustrating a preferred embodiment of the invention, and not for the purpose of limiting same, FIG. 1 shows the construction of a hockey stick 10 having a shaft or handle 12, a blade 14, and a shank 16 which interconnects shaft 12 and blade 14. The present invention relates generally to shaft 12, and more particularly, to a non-metallic shaft 12 having a thin metallic outer layer to enhance the appearance thereof. The invention is particularly applicable for providing a metallic appearance to a polymer/graphite composite elongated hollow shaft 12 and will be described with particular reference thereto. However, it will be appreciated from a further reading of the specification that the present invention may also be used for providing a metallic finish on shafts of wood, other fibrous materials, plastic, or composites, such as fiberglass, graphite, KEVLAR (which is a registered trademark of E. I. DuPont de Nemours & Co.), or for providing a metallic finish on blade 14 or an "end plug" (not shown) which is sometimes incorporated into the end of the shaft opposite blade 14 to increase the length thereof, without deviating from the present invention.

Figure 2:
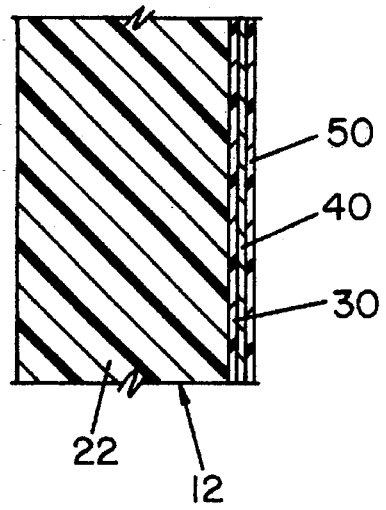
FIG. 2 is an enlarged sectional view taken along line 2—2 of FIG. 1 illustrating the surface composition thereof.

Referring now to FIG. 2, a cross-sectional view of shaft 12 is shown. In the embodiment shown, shaft 12 is hollow and has a generally rectangular cross-section and an inner cavity which defines a wall portion 22. A first layer 30 of an adhesion-promoting and surface-smoothing material is preferably applied to wall portion 22 of shaft 12. Layer 30 may or may not be required, depending upon the material forming shaft 12. Layer 30 is preferably an inert material which would adhere to shaft 12 and provide a good adhesion promoting outer surface. The material must also be sufficiently resilient and tough enough to withstand the normal flexing and impact typically experienced by the shaft of a hockey stick in normal use.

In addition to the foregoing, the material forming layer 30 should have a temperature resistance when cured or set. In this respect, shaft 12 of hockey stick 10 is typically assembled to blade 14 by means of a hot melt adhesive (not shown) applied to shank 16. Generally, a "heat-wrap" having electrical heating element therein is wrapped around shaft 12 to preheat same prior to assembly. Such heat-wrap may generate sufficient heat to heat the shaft up to over 300° F. and up. It is therefore necessary that layer 30 should be able to withstand temperatures presently estimated in the area of 300° F. without discoloration, melting or deteriorating in any way. Organic materials, such as varnishes or polymeric materials such as thermosets, as for example, epoxies, urethanes, and thermoplastics as for example, acrylics and polyesters, may form layer 30. In a preferred embodiment, a so-called "long-oil" vanish is used. A "long-oil" varnish requires a longer drying time and gives softer films than "short-oil" varnishes, but are more flexible and tougher. The varnish has a thickness of approximately 0.0015 inch.

According to the present invention, an extremely thin layer of metal 40 is applied to shaft 12 over layer 30. Metal layer 40 may be applied by several different processes, such as vacuum vapor deposition, ion sputtering, metallic arc spray or electrodeposition. Vacuum vapor deposition and metal sputtering deposition are believed to be the preferable methods of applying metal layer 40 because of the ability to control the thickness of the metal as well as the brilliant finish of the metal coated object. Electrodeposition is believed to be the least desirable of the aforementioned processes because of the less than satisfactory coating created by such process. The poorer results are caused by the difficulty of electrically charging a non-metallic shaft as well as the difficulty of creating a uniform current density therealong.

Vacuum vapor metallizing is a process for depositing metals or alloys, under high vacuum conditions, upon surfaces of metals, plastic, paper, textiles or other materials. Articles to be metalized are mounted on a suitable folding fixture and placed within a vacuum chamber with a small amount of metallizing material. The metallizing material is either hung from tungsten filaments used to melt the material, or is contained in boats or crucibles. A very high vacuum, on the order of 0.5 micron (0.0005 mmHg) or lower, is produced in the chamber. The tungsten filaments are heated until the metallizing material vaporizes and radiates throughout the chamber. As the metal vaporizes, contaminants such as organic materials (i.e., grease, oil, etc.), moisture and oxides are desorbed from the metal, producing vaporized particles of extremely pure metal. The vaporized metal which radiates from the tungsten filaments or crucibles condenses upon the articles within the chamber, i.e., shafts 12. Vacuum metallizing produces a coating which is extremely thin and because of the purity of the metal produces a brilliant finish, which precisely follows the pattern of the coated object. The coating thickness can be controlled to one ten-millionth inch. Importantly, vacuum vapor metallizing does not require the work piece to be electrically conductive, thereby allowing shafts 12 formed of non-conductive or poorly conductive plastics or graphite material to be coated.

Metal deposition by sputtering is a process which also applies metal or alloy under vacuum conditions. Articles to be metalized are mounted within a vacuum chamber together with a target (plate) of the metallizing material. Charged ions are accelerated toward the target of metallizing material. The ions cause metal to be released from the target (plate) and to collect on the article, i.e., shaft 12. As with the vapor deposition process, an extremely thin coating of brilliant finish may be applied to shaft 12.

The metal applied to shaft 12 according to either process is preferably selected from the group consisting of aluminum, copper, gold or silver. Aluminum is particularly applicable because of the brilliant high gloss finish, as well as its cost relative to the other materials. Layer 40 of deposited metal preferably has a thickness of less than 0.000010 inch (i.e., ten millionth inch) and preferably approximately 0.000004 inches (i.e., four millionth inch).

To protect metallic layer 40, a thin outer layer 50 of a clear material is applied over metallic layer 40. Outer layer 50 may be applied by an atomized spray, or may be applied by the ion sputtering technique just described, to minimize the thickness of layer 50. As with layer 30, outer layer 50 is preferably formed of a tough, yet elastic material which bonds to metallic layer 40. A thermosetting polymer material such as epoxy or polyurethane or a thermoplastic such as polymethyl methacrylate, lacquer, enamel, varnish, or like material may be used at layer 50.

Figure 3:
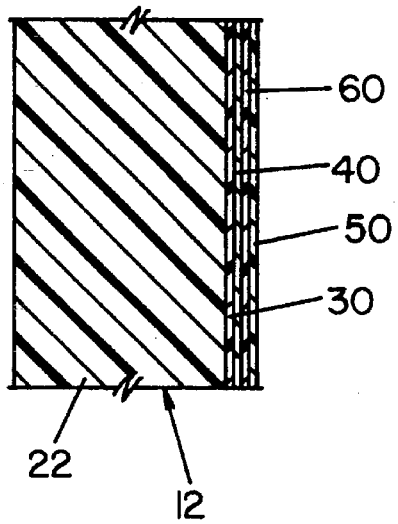
FIG. 3 is a sectional view of a shaft illustrating a surface composition according to another aspect of the present invention.

Referring now to FIG. 3, according to another aspect of the present invention, a thin intermediate colored layer 60 of a clear material may be provided between metallic layer 40 and protective layer 50. Layer 60 may be formed of a clear material which will absorb dyes if exposed thereto or may be a coating, such as the previously described varnish, lacquer or polyurethane having a colorant added thereto. In this respect, the brilliant silver color of an aluminum layer 40 would be covered by a clear color layer, e.g., blue, red, green, etc., to provide a tinted metallic appearance. An additional protective layer 50 may be applied thereto as discussed above. In this respect, layers 30, 50 and 60 may be the same material merely applied in distinct layers as set forth above. According to the present invention, layers 30, 40, 50 and 60 are preferably applied such that the overall thickness of layers 30, 40, 50 and 60 is less than 0.003 inch.

The present invention thus provides au extremely thin metallic coating and protective layer for non-metallic hockey shafts, thereby providing the appearance of metal. Moreover, unlike a metallic paint, such as an aluminum paint, the deposited metal layer 40 is much thinner and purer in composition. Importantly, the extremely thin layers do not materially affect the mechanical performance characteristics of the composite shaft, and yet are tough enough to withstand impacts exerted thereon.

The present invention has been described with respect to a preferred embodiment. Modifications and alterations will occur to those skilled in the art upon a reading and understanding of the specification. For example, although the embodiments have been described with respect to the shaft 12, blade 14 could also be metalized as described above. It is intended that all such modifications and alterations be included insofar as they come within the scope of the claims or the equivalents thereof.

Thus having described the invention, the following is claimed:

1. A hockey stick comprised of:

a non-metallic elongated shaft member;

a first layer of a resilient yet tough polymeric material bonded to said shaft member to form a smooth continuous surface;

a uniform, continuous layer of metal having a thickness not greater than 0.00001 inch applied to said first layer of polymeric material by a vacuum deposition process to provide a metallic appearance to said shaft member; and a second layer of a resilient tough clear material encasing said layer of metal, said first and second layers of material having a temperature resistance sufficient to avoid melting, discoloration and decomposition of said layers.

2. A shaft for a hockey stick as defined in claim 1, wherein said first layer and said second layer are formed of the same material.

3. A shaft for a hockey stick as defined in claim 2, wherein said first and second layers are formed of a siliconized polyester.

4. A shaft for a hockey stick comprised of:

a composite tube formed of graphite fiber in a polymer matrix;

a smooth base layer of a plastic material bonded to said tube to form a smooth continuous surface:

a uniform, continuous metallic layer encasing said base layer, said metallic layer applied to said base layer by a vacuum deposition procedure wherein said shaft has the appearance of being metal; and a top layer of a clear plastic material, said base coat, metal layer and top coat having a thickness of less than approximately 0.003 inches.

5. A shaft for a hockey stick as defined in claim 4, wherein said shaft includes a colored layer of a clear plastic material disposed between said metal layer and said top layer.

6. A shaft for a hockey stick as defined in claim 4, wherein said metal layer is formed from a metal selected from the group consisting of aluminum, copper, silver or gold.

* * * * *